United States Patent [19]

Moore et al.

[11] Patent Number: 4,715,979

[45] Date of Patent: Dec. 29, 1987

[54] GRANULAR DETERGENT COMPOSITIONS HAVING IMPROVED SOLUBILITY

[75] Inventors: Jeffrey E. Moore; Brett A. Evans; Richard Hansen, all of Cincinnati, Ohio

[73] Assignee: The Procter & Gamble Company, Cincinnati, Ohio

[21] Appl. No.: 916,985

[22] Filed: Oct. 9, 1986

Related U.S. Application Data

[63] Continuation of Ser. No. 785,933, Oct. 9, 1985, abandoned.

[51] Int. Cl.[4] ..... C11D 1/12; C11D 1/755

[52] U.S. Cl. ..... 252/91; 252/558; 252/135; 252/531; 252/534; 252/540; 252/550; 206/0.5; 162/109; 383/118

[58] Field of Search ..... 252/90, 135, 531, 532, 252/533, 535, 536, 539, 540, 550, 551, 553, 554, 555, 556, 558, 559, 91; 162/109; 383/118; 206/0.5

[56] References Cited

U.S. PATENT DOCUMENTS

| | | | |
|---|---|---|---|
| 4,028,283 | 6/1977 | Murata | 252/551 |
| 4,141,841 | 2/1979 | McDanald | 252/8.8 |
| 4,571,924 | 2/1986 | Bahrani | 53/453 |
| 4,638,907 | 1/1987 | Bedenk | 206/0.5 |

FOREIGN PATENT DOCUMENTS

| | | |
|---|---|---|
| 106509 | 8/1979 | Japan . |
| 60-72999 | 4/1985 | Japan . |
| 72998 | 4/1985 | Japan . |

*Primary Examiner*—Paul Lieberman
*Assistant Examiner*—John F. McNally
*Attorney, Agent, or Firm*—Donald E. Hasse; Robert B. Aylor; Thomas H. O'Flaherty

[57] ABSTRACT

Spray dried detergent granules containing high levels of certain surfactants are compacted under certain conditions and admixed with other ingredients to form dense, rapidly dissolving detergent compositions.

24 Claims, No Drawings

GRANULAR DETERGENT COMPOSITIONS HAVING IMPROVED SOLUBILITY

This application is a continuation of application Ser. No. 785,933 filed Oct. 9, 1985, now abandoned.

TECHNICAL FIELD

The present invention relates to granular detergent compositions containing a specific mixture of alkylbenzene sulfonate surfactant, alkyl sulfate surfactant, alkali metal silicate and water-soluble sulfate. The compositions are prepared by drying, preferably by spray-drying, an aqueous slurry comprising the above components. While the compositions preferably also contain detergent builder materials, there should be relatively little or no pyrophosphate or anhydrous Form I tripolyphosphate builder in that portion of the composition prepared by drying the slurry comprising the sulfonate and sulfate surfactants, silicate and sulfate.

Mixtures of alkylbenzene sulfonate and alkyl sulfate surfactants are desired for optimum detergency performance. However, such mixtures tend to gel on contact with water. This can result in poor solubility of granules having high levels of alkylbenzene sulfonate and alkyl sulfate surfactants, particularly when such granules are incorporated in dense detergent compositions.

It has now been found that very soluble granular detergent compositions containing high levels of alkylbenze sulfonate and alkyl sulfate surfactants can be obtained by drying an aqueous slurry comprising the surfactants, silicate in a weight ratio of surfactant to silicate within the range of from about 1.5:1 to about 6:1, sulfate and relatively little or no pyrophosphate or anhydrous Form I tripolyphosphate detergent builder material. In preferred compositions, these soluble detergent granules are admixed or agglomerated with builders and other optional detergent ingredients. Particularly preferred compositions are obtained by admixing the soluble granules with builders, compacting the admix at relatively low pressures (e.g., about 20 to about 200 psi), and optionally admixing additional builders and other ingredients to provide finished granular detergent compositions.

BACKGROUND ART

U.S. Pat. No. 4,028,283, Murata et al, issued June 7, 1977, discloses granular detergents containing surfactants having a tendency to cake and an anticaking agent formed by reacting polyethylene glycol with an acid anhydride. The compositions can also contain 0–20% of other surfactants such as alkylbenzene sulfonates. Spray-dried detergents containing mixtures of alkylbenzene sulfonate and alkyl ethoxy sulfate surfactants, silicate and builders are exemplified.

U.S. Pat. No. 4,141,841, McDanald, issued Feb. 27, 1979, discloses granular detergents containing particulate antistatic/softening additives. In Example 8, the particles are mixed with spray-dried base granule containing about 27% of a mixture of alkylbenzene sulfonate and alkyl ethoxy sulfate surfactants, 18% silicate and about 22% sodium tripolyphosphate.

Japanese OPI No. 106509, published Aug. 21, 1979, discloses spray-dried granular detergents containing 15–40% surfactant, 5–20% silicate and no more than 12% phosphate. The compositions are said to have good phosphate. The compositions are said to have good physical properties and to cause less deposition of insolubles on clothes.

Japanese OPI No. 72998 and 72999, published Apr. 25, 1985, disclose dense granular detergents formed by high shear mixing of alkylbenzene sulfuric acid and alkyl sulfuric acid with sodium carbonate and water to cause neutralization, admixing other ingredients such as builders, and then crushing and granulating the mixture.

SUMMARY OF THE INVENTION

This invention relates to a granular detergent composition prepared by:

(1) forming base granules comprising, by weight:

(a) from about 30% to about 85% of a mixture of a $C_{11}$–$C_{13}$ alkylbenzene sulfonate surfactant and a $C_{12}$–$C_{16}$ alkyl sulfate surfactant in a weight ratio of sulfonate surfactant to sulfate surfactant of from about 4:1 to about 1:4;

(b) an alkali metal silicate having a molar ratio of $SiO_2$ to alkali metal oxide of from about 1.0 to about 3.2; the weight ratio of (a) to (b) being from about 1.5:1 to about 6:1;

(c) from about 10% to about 60% of a watersoluble sulfate; and (d) from 0% to about 20% of a pyrophosphate or anhydrous Form I tripolyphosphate detergent builder material, or mixtures thereof; said base granules prepared by drying an aqueous slurry comprising the above components;

(2) admixing said base granules with from 0% to about 300%, by weight of the base granules, of a detergent builder material;

(3) compacting said admix at a pressure of from about 20 to about 200 psi;

(4) granulating the resulting compacted admix; and (5) admixing an additional 0% to about 300%, by weight of the base granules, of a detergent builder material;

said composition having a bulk density of from about 0.55 to about 1.2 g/cc and an average particle size of from about 20 to about 1500 microns.

DETAILED DESCRIPTION OF THE INVENTION

The granular detergent compositions of the present invention contain from about 30% to about 85%, preferably from about 35% to about 60%, more preferably from about 40% to about 50%, by weight of a mixture of $C_{11}$–$C_{13}$ alkylbenzene sulfonate surfactant and $C_{12}$–$C_{16}$ alkyl sulfate surfactant in a weight ratio of sulfonate surfactant to sulfate surfactant of from about 4:1 to about 1:4, preferably from about 3:1 to about 1:3, more preferably from about 2:1 to about 1:2.

Sulfonate surfactants useful herein are the watersoluble salts, particularly the alkali metal, ammonium and alkanolammonium (e.g., monoethanolammonium or triethanolammonium) salts of alkylbenzene sulfonates in which the alkyl group contains from about 11 to about 13 carbon atoms, in straight chain or branched chain configuration, e.g., those of the type described in U.S. Pat. Nos. 2,220,099 and 2,477,383, incorporated herein by reference. Preferred are linear straight chain alkylbenzene sulfonates in which the average number of carbon atoms in the alkyl group is from about 12 to about 13.

Useful alkyl sulfate surfactants are the watersoluble salts, particularly the alkali metal, ammonium and alkanolammonium (e.g., monoethanolammonium or triethanolammonium) salts of $C_{12}$–$C_{16}$ linear or branched alkyl sulfates. Preferred are those containing a $C_{12}$–$C_{15}$, especially $C_{14}$–$C_{15}$, linear alkyl group.

The compositions herein can also contain minor amounts (generally less than about 30%, but preferably less than about 15%, by weight of the above sulfonate and sulfate surfactants) of other detergent surfactants known in the art. These can include anionic, nonionic, cationic, ampholytic and zwitterionic surfactants, such as those disclosed in U.S. Pat. No. 3,919,678, Laughlin, et al, issued Dec. 30, 1975, incorporated herein by reference.

The compositions of the present invention also contain an alkali metal silicate having a molar ratio of $SiO_2$ to alkali metal oxide of from about 1.0 to about 3.2, preferably from about 1.6 to about 2.4. Sodium silicate, particularly having a molar ratio of from about 1.6 to about 2.2, is preferred.

The alkali metal silicates can be purchased in either liquid or granular form. Silicate solutions or slurries can conveniently be used to avoid having to dissolve the dried form in the aqueous slurry (e.g., crutcher mix) of the components herein.

In addition, the weight ratio of the alkylbenzene sulfonate plus alkyl sulfate surfactants herein to the alkali metal silicate should be from about 1.5:1 to about 6:1, preferably from about 2:1 to about 4:1, more preferably from about 2.5:1 to about 3.5:1.

The present compositions further contain from about 10% to about 60%, preferably from about 20% to about 50%, by weight of a water-soluble (preferably sodium) sulfate. Sodium sulfate is usually formed during the sulfation/sulfonation and neutralization steps in the production of the alkylbenzene sulfonate and alkyl sulfate surfactants herein.

The compositions herein are prepared by drying an aqueous slurry comprising the components. The slurry generally contains from about 25% to about 70%, preferably from about 40% to about 60%, water, whereas the dried granules initially contain from about 1% to about 10%, preferably from about 1% to about 3%, water. The drying operation can be accomplished by any convenient means, such as by using spray-drying towers, both counter-current and co-current, fluid beds, flash-drying equipment, or industrial microwave or oven-drying equipment. These are more fully described in U.S. Pat. No. 4,019,998, Benson et al, issued Apr. 26, 1977 (particularly from Column 14, line 19 to Column 15, line 9), incorporated herein by reference.

The granular detergents herein are very soluble in the wash water even though they contain high levels of alkylbenzene sulfonate and alkyl sulfate surfactants. Good solubility is obtained when the weight ratio of total sulfonate plus sulfate surfactant to silicate is within the about 1.5:1 to about 6:1 range specified above. While not intending to be limited by theory, it is believed that this relatively high level of silicate provides structure and helps to maintain integrity of the high surfactant granules and that this minimizes gelling when the surfactants contact the wash water. However, if the silicate level becomes too high (e.g., a surfactant to silicate ratio of 1:1), overall solubility can suffer due to the formation of silicate insolubles. On the other hand, granules having a surfactant to silicate ratio of, for example, 8:1, have insufficient structure and tend to be too mushy at these high surfactant levels.

For good solubility, the amount of pyrophosphate or anhydrous Form I tripolyphosphate detergent builder material in the portion of the granular detergent obtained by drying an aqueous slurry of the essential components herein should also be minimized. Thus the compositions can contain from 0% to about 20%, preferably from 0% to about 15%, more preferably from 0% to about 10%, by weight of such detergent builder material, or mixtures thereof. Most preferably, the compositions are substantially free of such detergent builder (e.g., they contain less than about 5%, preferably less than about 3%, by weight of builder).

The compositions can contain up to about 60%, preferably from about 1% to about 45%, by weight of other detergent builders, including those described in U.S. Pat. No. 3,925,262, Laughlin et al, issued Dec. 9, 1975, incorporated herein by reference. Builders are generally selected from the various water-soluble alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above.

Specific examples of inorganic phosphate builders are sodium and potassium tripolyphosphate (Form II or hydrated Form I), polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176; and 3,400,148, incorporated herein by reference.

Examples of nonphosphorus, inorganic builders are sodium and potassium carbonate, bicarbonate, sesquicarbonate, and tetraborate decahydrate.

Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are also described in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other useful builders herein are sodium and potassium carboxymethyloxymalonate, carboxymethyloxysuccinate, cis-cyclohexanehexacarboxylate, cis-cyclopentanetetracarboxylate, phloroglucinol trisulfonate, and the copolymers of maleic anhydride with vinyl methyl ether or ethylene.

Other suitable polycarboxylates are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution and converted to the corresponding salt.

A preferred phosphate builder is Form II sodium tripolyphosphate (STP) (preferably anhydrous). A preferred builder for use in compositions that are substantially free of phosphate builders is sodium citrate.

When admixed, the builders herein should have the same particle size as the remainder of the composition, as described hereinafter.

The above granular detergent compositions can be used as is as finished detergent compositions or as detergent additive compositions. However, they are preferably used as (and hereinafter referred to as) detergent base granules which are then admixed or agglomerated with builder material and with other optional ingredients to provide finished detergent compositions exhibiting good solubility. Such finished compositions can comprise by weight from about 5% to about 50%, preferably from about 10% to about 40%, more preferably from about 12% to about 25%, of the alkylbenzene sulfonate and alkyl sulfate surfactants herein and from about 5% to about 95%, preferably from about 10% to about 85%, more preferably from about 15% to about 75%, of detergent builder material, such as described above. However, for best solubility, the amount of pyrophosphate and anhydrous Form I tripolyphosphate should be minimized, i.e., the finished compositions preferably contain from 0% to about 20%, preferably from 0% to about 10%, of such material, or mixtures thereof.

The compositions can also contain minor amounts, generally less than 30%, preferably less than 20%, by weight of other ingredients usually included in detergent compositions. These include auxiliary detergent surfactants, color speckles, bleaching agents, and bleach activators, suds boosters or suds suppressors, antitarnish and anticorrosion agents, soil suspending agents, soil release agents, dyes, fillers, optical brighteners, germicides, pH adjusting agents, nonbuilder alkalinity sources, enzymes, enzyme-stabilizing agents and perfumes.

Agglomeration can be accomplished by agitating in the presence of a suitable binder (e.g., in a fluidized bed, tumble mixer, or a rotating drum or pan) or by mechanically mixing under pressure (e.g., extruding, pressing, milling, compacting or pelletizing). Final sizing can then be achieved by grinding and screening.

In a preferred embodiment, the detergent base granules are admixed with from 0% to about 300%, preferably from about 25% to about 200%, more preferably from about 50% to about 150%, by weight of the base granules, of a detergent builder material such as described above. The resulting admix is then preferably compacted at a relatively low pressure of from about 20 to about 200, preferably from about 40 to about 150, more preferably from about 50 to about 100, pounds per square inch (psi). The composition is then preferably admixed with an additional 0% to about 300%, preferably from about 25% to about 200%, more preferably from about 50% to about 150%, by weight of the base granules, of a detergent builder material. The above levels and types of builder material and compaction pressure are preferably selected so that the final detergent composition has a bulk density of from about 0.55 to about 1.2, preferably from about 0.65 to about 1.1, more preferably from about 0.7 to about 0.9 g/cc and an average particle size of from about 20 to about 1500 microns, preferably from about 50 to about 1200 microns, more preferably from about 100 to about 800 microns.

The above compaction step is preferably accomplished by using equipment that applies a relatively uniform compaction pressure, for example, by using compaction rollers with smooth (i.e., noncorrugated) surfaces. After compaction, the composition is preferably granulated and screened to provide an average particle size similar to that desired for the final composition.

The following nonlimiting examples illustrate the detergent compositions of the present invention.

All percentages, parts and ratios are by weight unless otherwise specified.

EXAMPLE I

The following granular detergent composition was prepared.

| | Base Granules | |
|---|---|---|
| | Weight % | Grams Final Composition per use |
| Sodium $C_{13}$ linear alkylbenzene sulfonate | 22.1 | 5.110 |
| Sodium $C_{14-15}$ alkyl sulfate | 22.1 | 5.110 |
| Sodium silicate (1.6 ratio) | 13.7 | 3.172 |
| Sodium sulfate | 32.2 | 7.455 |
| Polyethylene glycol (m. wt. 8000) | 1.5 | 0.340 |
| Sodium polyacrylate (m. wt. 4500) | 2.0 | 0.453 |
| $C_{12-13}$ alcohol polyethoxylate (6) | 3.0 | 0.680 |
| Sodium diethylenetriamine pentaacetate | 1.5 | 0.340 |
| Moisture | 2.0 | 0.462 |
| | | 23.122 |
| **Preblend** | | |
| Base granules | | 23.122 |
| Sodium tripolyphosphate hexahydrate (powdered form) | | 20.576 |
| | | 43.698 |
| **Admix** | | |
| Preblend | | 43.698 |
| Sodium tripolyphosphate hexahydrate (granular) | | 19.429 |
| Dye | | 0.003 |
| Brightener | | 0.613 |
| Suds suppressor prill comprising dimethylsilicone, silica, sodium tripolyphosphate and polyethylene glycol (MW = 8000) | | 1.703 |
| Protease | | 2.044 |
| Sodium carbonate | | 4.000 |
| | | 71.490 |
| **Spray-On** | | |
| Admix | | 71.490 |
| Mineral oil | | 0.710 |
| | | 72.200 |

The base granules were produced by spray-drying an aqueous crutcher mix of the components on a ten foot tower using a crutcher temperature of 200° F., a size 3½ (7/64 in. diameter) nozzle to make fine granules, and silicone deaeratants. If the base granules contained more than 2% moisture, a second drying stage on a continuous fluid bed was performed to reduce moisture to 2%.

The base granules were then admixed with powdered STP hexahydrate to form the preblend. The preblend was compacted at 50 psig roll pressure on a 4 in. by 10 in. chilsonator. (This provided a compaction force of about 250 pounds per lineal inch across the rolls. On larger size compacting roller presses, i.e., those having roll diameters of from about 500 mm to about 1,000 mm, the desired low pressure compaction can be obtained by using a force of from about 1,000 to about 15,000, preferably from about 2,000 to about 10,000, more preferably from about 2,500 to about 6,000, pounds per lineal inch across the rolls. For example, a force of about 2,800 to about 5,600 pounds per lineal inch across the rolls would provide the desired compaction when using a 600 mm diameter roll press having a pocketed-face, which is preferred for improved product feeding characteristics.) The product was then screened to select a −14(1168 microns)/+65(208 microns) particle size cut (Tyler mesh). Oversized particles were collected and granulated on a Fitzmill using a 14 mesh screen and low rpm's. This was screened to select a −20(833 microns)/+48(295 microns) particle size cut. Both materials were dedusted by blowing off fines in a fluid bed dryer using ambient air.

The admix was prepared at 400 pounds per batch in a drum mixer. Carbonate, granular STP (with dye sprayed-on), brightener, enzymes, and suds supressor prills were blended with the compacted mainstream product cut and regranulated overs. The ratio of mainstream product cut to overs was 7 to 1. Mineral oil was sprayed on the final admix in 30 to 40 pound batches at a 1% level using a Forberg Mixer.

The composition of Example I preferably contains 15.33 grams of anhydrous Form II sodium tripolyphosphate powder in both the preblend and the admix instead of the sodium tripolyphosphate hexahydrate.

The composition of Example 1 is preferably incorporated into a laminated laundry product formed from two plies of water insoluble tissues, at least one of which is water permeable, which are laminated together. At least one of the plies has cup like depressions, surrounded by rims and the other ply being attached to the first ply at the rim to physically separate the cups. In one embodiment the laminate is made with plies of the tissue paper described by Trokhan in U.S. Pat. No. 4,529,480, issued July 16, 1985, incorporated herein by reference. The tissue had good air permeability as set forth in U.S. Pat. No. 4,170,565, Flesher et al, issued Oct. 9, 1979, said patent being incorporated herein by reference. There are 12 cups, having about 20 cc capacity each and at least 8 of the cups are filled with about 9 gm (11 cc) of the detergent composition and the other cups are filled with at least one detergent adjuvant. Other materials which can be used to form suitable laminates and processes for forming suitable laminates are disclosed in U.S. Pat. No. 4,571,924, Bahrani, issued Feb. 25, 1986, and in the Bedenk, U.S. patent application of Ser. No. 675,804, filed Nov. 28, 1984, both being incorporated herein by reference.

When the composition of Example 1 is incorporated in said laminated laundry product, it exhibits superior solubility.

EXAMPLE II

The following granular detergent composition can be prepared and used according to Example I.

| | Base Granules | |
|---|---|---|
| | Weight % | Grams Final Composition per use |
| Sodium $C_{13}$ linear alkylbenzene sulfonate | 15.75 | 6.81 |
| Sodium $C_{14-15}$ alkyl sulfate | 15.75 | 6.81 |
| Sodium silicate (1.6 ratio) | 7.88 | 3.41 |
| Sodium sulfate | 23.01 | 9.95 |
| Polyethylene glycol (m. wt. 8000) | 0.78 | 0.34 |
| Sodium polyacrylate (m. wt. 4500) | 1.05 | 0.46 |
| $C_{12-13}$ alcohol polyethoxylate (6) | 1.57 | 0.68 |
| Sodium citrate | 32.15 | 13.90 |
| Unreacted | 0.35 | 0.15 |
| Moisture | 1.7 | 0.73 |
| | 43.23 | |
| **Preblend** | | |
| Base granules | | 43.23 |
| Sodium aluminosilicate (hydrated Zeolite A, avg. dia 3 microns) | | 14.90 |
| Sodium carbonate | | 3.00 |
| | | 61.13 |
| **Admix** | | |
| Preblend | | 61.13 |
| Brightener | | 0.53 |
| Suds suppressor prill comprising dimethylsilicone, silica, sodium tripolyphosphate and polyethylene glycol (MW = 8000) | | 0.91 |
| Protease | | 1.00 |
| | | 63.57 |

What is claimed is:

1. A granular rapidly dissolving detergent composition prepared by:
   (1) forming base granules comprising, by weight:
      (a) from about 30% to about 85% of a mixture of a $C_{11}$–$C_{13}$ alkylbenzene sulfonate surfactant and a $C_{12}$–$C_{16}$ alkyl sulfate surfactant in a weight ratio of sulfonate surfactant to sulfate surfactant of from about 4:1 to about 1:4;
      (b) an alkali metal silicate having a molar ratio of $SiO_2$ to alkali metal oxide of from about 1.0 to about 3.2; the weight ratio of (a) to (b) being from about 1.5:1 to about 6:1;
      (c) from about 10% to about 60% of sodium sulfate; and
      (d) from 0% to about 20% of a pyrophosphate or anhydrous Form I tripolyphosphate detergent builder material, or mixtures thereof; said base granules prepared by drying an aqueous slurry comprising the above components;
   (2) admixing said base granules with from 0% to about 300%, by weight of the base granules, of a detergent builder material;
   (3) compacting said admix at a pressure of from about 20 to about 200 psi;
   (4) granulating the resulting compacted admix; and
   (5) admixing an additional 0% to about 300%, by weight of the base granules, of a detergent builder material; said composition having a bulk density of from about 0.55 to about 1.2 g/cc and an average particle size of from about 20 to about 1500 microns.

2. The composition of claim 1 wherein the base granules comprise from about 35% to about 60% of the sulfonate and sulfate surfactants, in a weight ratio of sulfonate surfactant to sulfate surfactant of from about 2:1 to about 1:2.

3. The composition of claim 2 wherein the sulfonate surfactant is sodium $C_{12}$–$C_{13}$ linear alkylbenzene sulfonate and the sulfate surfactant is sodium $C_{14}$–$C_{15}$ linear alkyl sulfate.

4. The composition of claim 1 wherein the weight ratio of (a) to (b) is from about 2.5:1 to about 3.5:1.

5. The composition of claim 3 wherein the weight ratio of (a) to (b) is from about 2:1 to about 4:1, and the alkalimetal silicate is sodium silfate having a molar ratio of $SiO_2$ to alkali metal oxide of from about 1.6 to about 2.4.

6. The composition of claim 1 wherein the base granules comprise from 0% to about 10% of a pyrophosphate or anhydrous Form I tripolyphosphate detergent builder material, or mixtures thereof.

7. The composition of claim 5 wherein the base granules are substantially free of pyrophosphate or anhydrous Form I tripolyphosphate detergent builder material.

8. The composition of claim 1 wherein the base granules are admixed with from about 50% to about 150%, by weight of the base granules, of a detergent builder material in step (2).

9. The composition of claim 8 wherein the detergent builder material comprises sodium tripolyphosphate hexahydrate.

10. The composition of claim 1 wherein the admix of step (2) is compacted at a pressure of from about 40 to about 150 psi.

11. The composition of claim 10 wherein the admix of step (2) is compacted at a pressure of from about 50 to about 100 psi.

12. The composition of claim 10 wherein the compacted admix of step (3) is admixed with an additional from about 50% to about 150%, by weight of the base granules, of a detergent builder material.

13. The composition of claim 1 having a bulk density of from about 0.7 to about 0.9 g/cc.

14. The composition of claim 8 wherein the admix of step (2) is compacted at a pressure of from about 40 to about 150 psi.

15. The composition of claim 14 wherein the compacted admix of step (3) is admixed with an additional from about 50% to about 150%, by weight of the base granules, of a detergent builder material.

16. The composition of claim 7 wherein the base granules are admixed with from about 50% to about 150%, by weight of the base granules, of sodium tripolyphosphate hexahydrate in step (2).

17. The composition of claim 16 wherein the admix of step (2) is compacted at a pressure of from about 50 to about 100 psi.

18. The composition of claim 17 wherein the compacted admix of step (3) is admixed with an additional from about 50% to about 150%, by weight of the base granules, of a detergent builder material.

19. The composition of claim 18 having a bulk density of from about 0.7 to about 0.9 g/cc.

20. The composition of claim 1 wherein the base granules further comprise up to about 60% by weight of detergent builder material, other than pyrophosphate or anhydrous Form I tripolyphosphate builders.

21. The composition of claim 20 wherein the base granules comprise from about 1% to about 45% by weight of detergent builder material, other than pyrophosphate or anhydrous Form I tripolyphosphate builders.

22. The composition of claim 1 which is substantially free of phosphate builder materials.

23. The composition of claim 22 further comprising sodium citrate.

24. A laminated laundry product comprising two plies of water insoluble tissue in which:

(1) at least one ply is water permeable;

(2) at least one ply defines more than one cup, each cup being surrounded by a rim of that ply;

(3) the second ply is sealed to the first ply at least at the rims of the cups to physically separate the cups so that the contents of the cups remain in place; and more than one cup contains the product of claim 1.

* * * * *